US011524221B2

(12) United States Patent
Bernocchi

(10) Patent No.: US 11,524,221 B2
(45) Date of Patent: Dec. 13, 2022

(54) DEVICE FOR COUPLING A GLOVE WITH A POLE FOR SPORTIVE PRACTICE

(71) Applicant: IN ACTION S.R.L., Turin (IT)

(72) Inventor: Flavio Bernocchi, Turin (IT)

(73) Assignee: IN ACTION S.R.L., Turin (IT)

( * ) Notice: Subject to any disclaimer, the term of this patent is extended or adjusted under 35 U.S.C. 154(b) by 466 days.

(21) Appl. No.: 16/463,587

(22) PCT Filed: Feb. 12, 2018

(86) PCT No.: PCT/IB2018/050836
§ 371 (c)(1),
(2) Date: May 23, 2019

(87) PCT Pub. No.: WO2018/167578
PCT Pub. Date: Sep. 20, 2018

(65) Prior Publication Data

US 2021/0275896 A1 Sep. 9, 2021

(30) Foreign Application Priority Data

Mar. 15, 2017 (IT) ..... 102017000028741

(51) Int. Cl.
*A63C 11/22* (2006.01)
*A41D 19/00* (2006.01)

(52) U.S. Cl.
CPC ..... *A63C 11/2224* (2020.08); *A41D 19/0037* (2013.01); *A63C 11/2228* (2020.08)

(58) Field of Classification Search
CPC ..... A63C 11/2224; A63C 11/2228; A63C 11/222; A63C 11/022; A41D 19/0037; A41D 19/0034
See application file for complete search history.

(56) References Cited

U.S. PATENT DOCUMENTS 3,620,543 A * 11/1971 Peis ..... A63C 11/022 280/601
4,234,202 A * 11/1980 Loffelholz ..... A63C 11/2228 280/820

(Continued)

FOREIGN PATENT DOCUMENTS

CA 2911899 A1 5/2016
CN 102083506 A 6/2011

(Continued)

OTHER PUBLICATIONS

Translated EP-0357517-A1 (Year: 2021).*

(Continued)

*Primary Examiner* — James A Shriver, II
*Assistant Examiner* — Ian Bryce Shelton
(74) *Attorney, Agent, or Firm* — Heslin Rothenberg Farley & Mesiti P.C.; Victor A. Cardona, Esq.

(57) ABSTRACT

A device for the coupling between a glove or other covering element of a user's hand and a pole for sportive practice includes a first magnetic coupling element associated or associable with the pole and a second magnetic coupling element associated or associable with the glove or with the other covering element. The first element is arranged at the handle of the pole, and the second element is arranged in such a way as to be positioned at the palm of the user's hand corresponding to an area between the thumb and index finger.

11 Claims, 5 Drawing Sheets

(56) References Cited

U.S. PATENT DOCUMENTS

| | | | | | |
|---|---|---|---|---|---|
| 5,328,205 | A * | 7/1994 | Bacharach | A63C 11/2228 | 2/161.1 |
| 5,443,287 | A * | 8/1995 | Wells | A63C 11/2224 | 280/822 |
| 5,715,539 | A * | 2/1998 | Benecki | A41D 19/01564 | 2/160 |
| 6,460,891 | B1 * | 10/2002 | Jones | A63C 11/221 | 280/821 |
| 2009/0230667 | A1 * | 9/2009 | Starry | A63C 11/228 | 280/814 |
| 2012/0061371 | A1 * | 3/2012 | Broom | A63C 11/228 | 219/211 |
| 2016/0377763 | A1 * | 12/2016 | Christian | G01N 3/42 | 324/345 |

FOREIGN PATENT DOCUMENTS

| | | | | | |
|---|---|---|---|---|---|
| CN | 205252480 | U * | 5/2016 | | |
| DE | 1578868 | A1 * | 9/1971 | A63C 11/022 | |
| DE | 2218723 | A1 * | 10/1973 | A63C 11/022 | |
| DE | 19810187 | A1 * | 9/1999 | A41D 19/0037 | |
| DE | 10325081 | A1 * | 12/2004 | A63C 11/22 | |
| DE | 202017100469 | U1 * | 2/2017 | A63C 11/222 | |
| DE | 202017100469 | U1 | 2/2017 | | |
| EP | 0357517 | A1 * | 3/1990 | A41D 19/0037 | |
| EP | 1970105 | A1 * | 9/2008 | A63C 11/222 | |
| EP | 2198935 | A2 | 6/2010 | | |
| EP | 2837415 | A1 * | 2/2015 | A63C 11/222 | |
| EP | 3020456 | A1 * | 5/2016 | A45B 9/02 | |
| EP | 3050603 | A2 * | 8/2016 | A45B 9/02 | |
| EP | 3050603 | A2 | 8/2016 | | |
| FR | 3032333 | A1 * | 8/2016 | A63C 11/222 | |
| IT | 1092835 | B | 7/1985 | | |
| WO | 2010081880 | A1 | 7/2010 | | |
| WO | WO-2010081880 | A1 * | 7/2010 | A63C 11/222 | |
| WO | WO-2012104457 | A1 * | 8/2012 | A63C 11/022 | |
| WO | WO-2012176053 | A1 * | 12/2012 | A63C 11/222 | |

OTHER PUBLICATIONS

Translated DE-19810187-A1 (Year: 2021).*
Translated WO-2012104457-A1 (Year: 2021).*
Translated EP-3050603-A2 (Year: 2021).*
International Search Report and Written Opinion of the International Searching Authority for PCT/IB2018/050836 dated Jun. 19, 2018.

* cited by examiner

DEVICE FOR COUPLING A GLOVE WITH A POLE FOR SPORTIVE PRACTICE

CROSS REFERENCE TO RELATED APPLICATIONS

This application is a national stage filing under section 371 of International Application PCT/IB2018/050836, filed on Feb. 12, 2018, published in English on Sep. 20, 2018 as WO2018/167578A1, and claims priority to Italian Application No. 102017000028741, filed on Mar. 15, 2017. The entire disclosures of each application are hereby incorporated herein by reference.

FIELD OF THE INVENTION

The present invention relates to a device for coupling a glove or other covering element of a user's hand with a pole for sportive practice, in particular a ski pole, comprising:

- at least one first magnetic coupling element associated or associable with said pole close to the upper end of said pole,
- at least one second magnetic coupling element associated or associable with said glove or with said other covering element,
- wherein at least one of said first and second magnetic coupling elements is a permanent magnet.

PRIOR ART

An exemplary device of the type indicated above is described and illustrated in the document IT 109 28 35 B.

In the specific case of ski poles, the most conventional solution involves associating a strap or the like with the pole, by means of which the user's hand can be secured to the pole. However, one of the drawbacks of such a device lies in that a user who has reached the end of the run on a ski-lift system is forced to stop to insert the straps of the pole handles onto the wrists. This operation causes the user to waste time and creates minor congestion close to the arrival station of the ski-lift system. Furthermore, in the event of a fall, the poles with the straps remain connected to the user's wrists, thus creating the possibility of injuries.

Devices have already been proposed for coupling between the pole and a glove that are mechanical, or that also provide, in addition to a mechanical device, a magnetic-type device. A coupling device of this type is described in the document CA 291 18 99 A1.

In order to simplify the complexity of devices that have both mechanical and magnetic constraints, purely magnetic devices have also been developed. A coupling device of this type is described in the document IT 109 28 35 B mentioned above. However, devices of this latter type, produced to date, are not fully satisfactory according to various points of view, particularly in terms of simplicity and ease of use, and in terms of efficiency of the gripping system between the glove and the pole.

OBJECT OF THE INVENTION

It is therefore an object of the invention to provide a device of the type indicated at the beginning of the present description that is simple and functional and that also has low production costs.

An additional object is to provide a versatile coupling device that is suitable to be implemented both on a glove and a pole initially produced with magnetic coupling elements, and on a glove and a pole that were not included with magnetic elements at the time of their production.

SUMMARY OF THE INVENTION

In view of achieving the aforesaid objects, the present invention relates to a device for coupling a glove or other covering element of a user's hand with a pole for sportive practice, in particular a ski pole, having all the characteristics indicated at the beginning of the present description and further characterized in that:

- said first element is arranged at the handle of said pole, and
- said second element is positioned at the palm of the user's hand corresponding to an area between the thumb and the index finger.

The invention can be applied by integrating the claimed device into the glove and into the pole from the start, or by providing the possibility of applying the claimed device to a glove and to a pole originally without this device. The case is also envisaged in which the device is not associated with a glove, but with another covering element of the hand, for example, in the form of a strap or a hand-covering element.

According to a relevant characteristic of the device according to the invention, the coupling between the glove or other covering element of the user's hand and the pole is achieved solely due to a magnetic force between the first element and the second element, without the aid of further elements.

According to a first embodiment of the invention, the first element and the second element are both permanent magnets, while in an alternative embodiment, either the first element or the second element is made of non-magnetized ferromagnetic material.

According to a preferred embodiment of the device, the pole handle has a grooved portion having a vertical wall with a substantially flat surface and a horizontal wall substantially arranged at 90 degrees with respect to the vertical wall, and the first element is integrated within the pole handle and is arranged adjacent to said grooved portion.

Thanks to the aforesaid characteristics and additional characteristics indicated in the attached claims and in the following description, the device according to the present invention achieves the predetermined objects.

DETAILED DESCRIPTION OF ALTERNATIVE EMBODIMENTS

Further characteristics and advantages of the invention will become apparent from the description that follows with reference to the attached drawings, provided purely by way of non-limiting example, wherein.

In the attached drawings, a device according to the invention is illustrated, for coupling the hand of a user with a pole 4 for sportive practice. With reference in particular to the illustrated embodiments, the pole 4 is a ski pole, but of course the present invention is also suitable for coupling devices for poles configured for other sportive practices (for example a trekking pole).

Figure 1A:
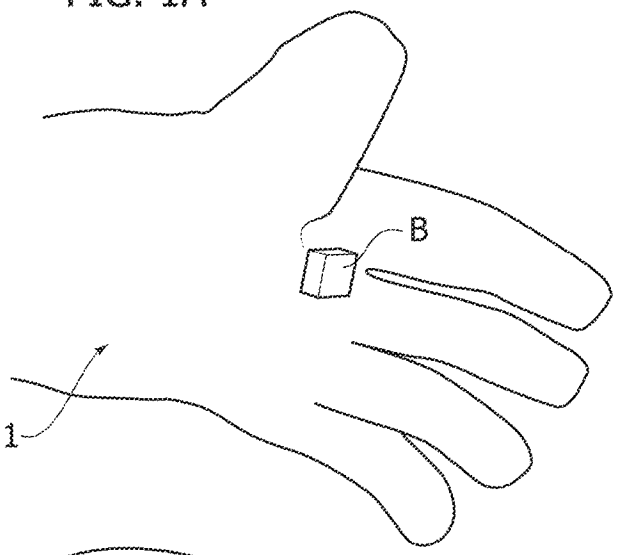
FIGS. 1A-1B illustrate, in particular, two perspective views of a magnetic coupling element associated or associable with a glove.
Figure 1B:
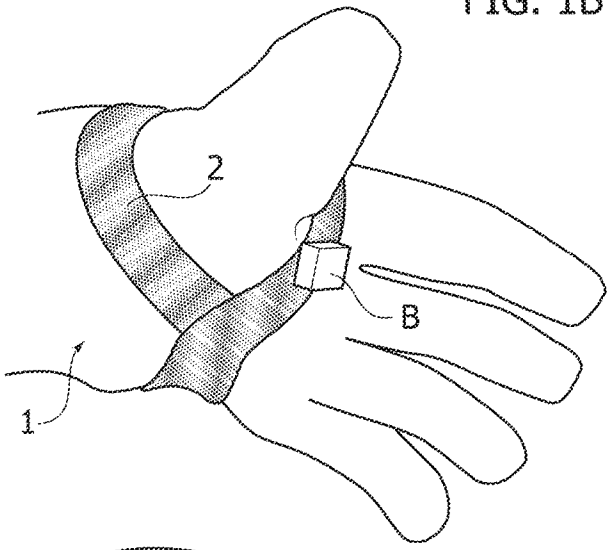
Figure 2A:
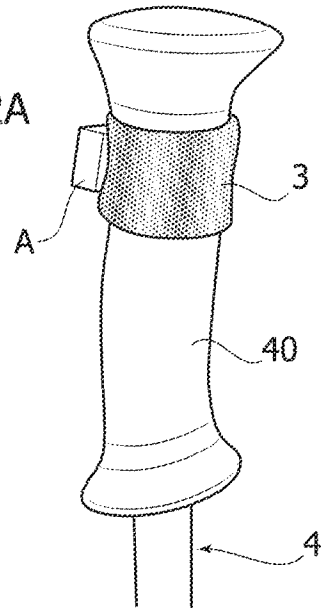
FIGS. 2A-2B illustrate, in particular, two perspective views of a magnetic coupling element associated or associable with a ski pole.
Figure 2B:
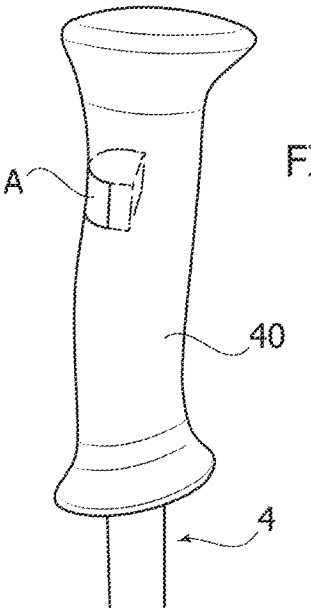

More particularly, the device according to the invention is designed for coupling between the pole 4 and a glove 1 (FIGS. 1A, 3A, 3B) or, alternatively, between the pole 4 and another covering element 2 (FIGS. 1B, 3C-5) associable with the glove 1.

According to a fundamental characteristic of the invention, the device comprises a first magnetic coupling element A associated with the pole 4 at one of its upper ends, and a second magnetic coupling element B associated with the glove 1. As illustrated in particular in the overall view of the device according to the invention (FIG. 5), the first magnetic coupling element A is arranged exactly at the handle 40 of the pole 4, while the second magnetic coupling element B is arranged in such a way as to be positioned at the palm of the user's hand corresponding to an area between the thumb and the index finger.

Thanks to the arrangement of the two magnetic coupling elements A, B in the positions described above, the magnetic force that is exerted between the first magnetic coupling element A and the second magnetic coupling element B is such as to allow rapid coupling between the glove 1 and the pole 4.

According to a first embodiment of the invention, the first element A and the second element B are both permanent magnets. Alternatively, either the first element A or the second element B is made of non-magnetized ferromagnetic material so that it is attracted to the other element consisting of a permanent magnet. In essence, in order to make the device according to the invention effective, it is only necessary that one of the first and second elements A, B is a permanent magnet.

Figure 3B:
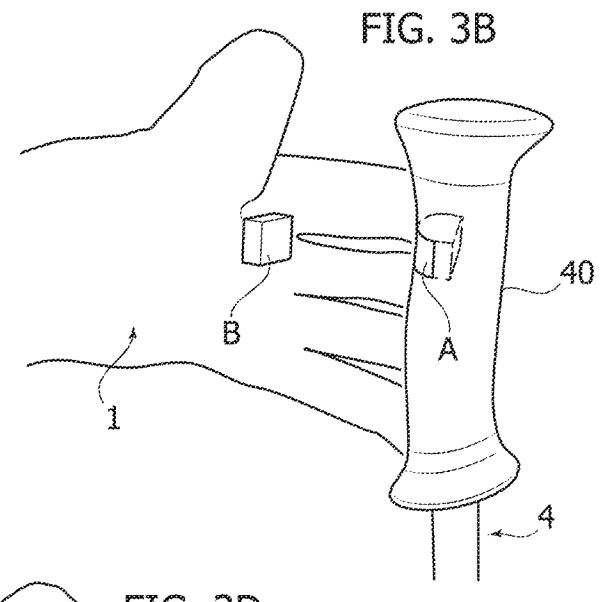
FIGS. 3A-3D show perspective views of alternative embodiments of the device according to the present invention.
Figure 3A:
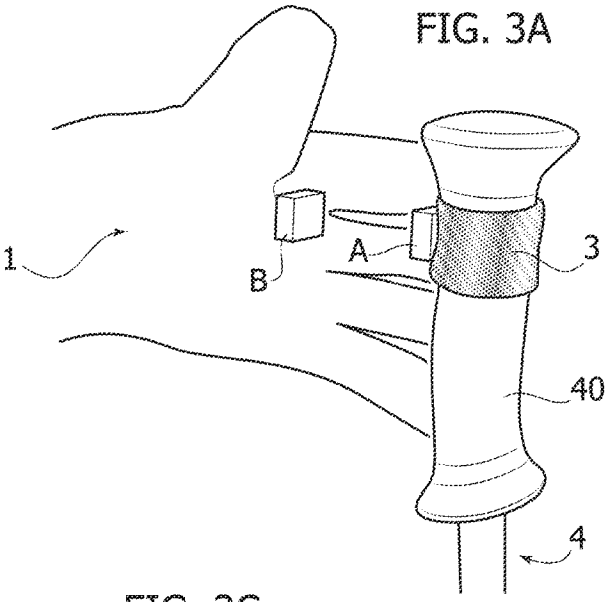
Figure 3D:
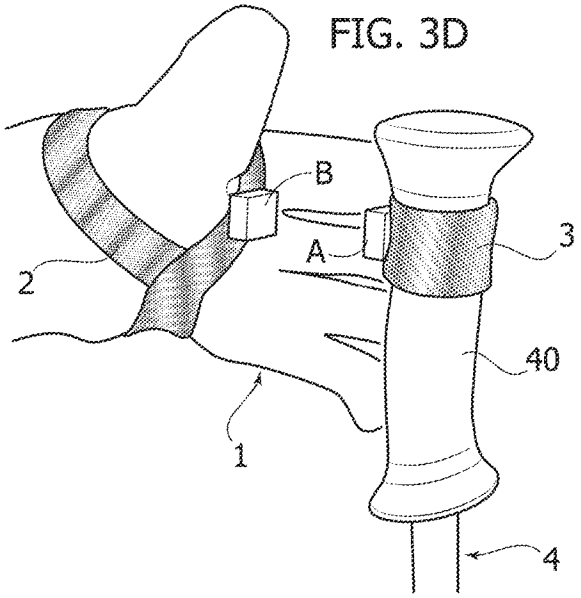
Figure 3C:
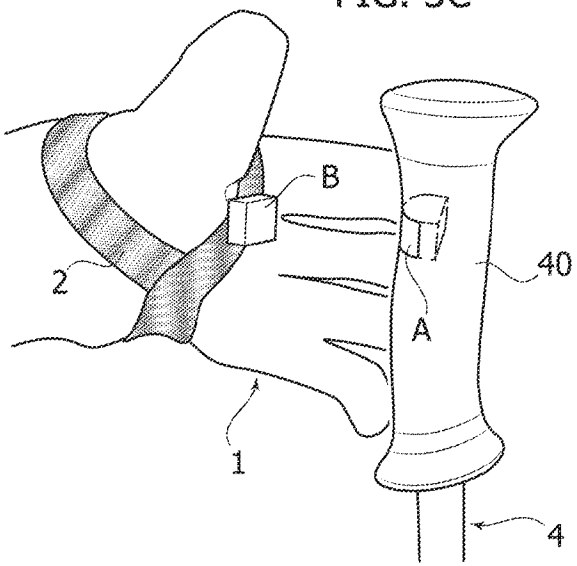

FIGS. 3A-3D illustrate various embodiments of the device according to the present invention in which:

- in FIG. 3A, the first element A is carried by a strap 3, which can be applied around the handle 40 of the pole 4, and the second element B is integrated into the glove 1;
- in FIG. 3B, the first element A and the second element B are integrated, respectively, into the handle 40 of the pole 4 and into the glove 1;
- in FIG. 3C, the first element A is integrated into the handle 40 of the pole 4, and the second element B is carried by a strap (or a sheath) 2 fitted over the glove 1;
- in FIG. 3D, the first element A is carried by the strap 3, which can be applied around the handle 40 of the pole 4 and the second element B is carried by a strap (or a sheath) 2 fitted over the glove 1.

According to the embodiments described above, the device according to the invention can also be implemented in the case in which the poles and/or the gloves are not initially provided with the integrated elements A, B.

Moreover, in the case in which the device according to the present invention is used for a walking-type non-winter sport using the aid of a pole, it is possible to use the device in the configuration in which the second element B is carried by a hand-covering strap, and can be worn directly on the user's hand (not illustrated in the drawings), in a manner completely similar to that shown in FIGS. 3C-3D (strap 2 above glove 1).

According to a fundamental characteristic of the device according to the invention, the coupling between the user's hand and the pole 4 is achieved solely due to the magnetic force exerted between the first element A and the second element B, without the aid of additional elements that create mechanical restraints (such as ties or snap-fit elements). Thanks to this characteristic, the device according to the invention provides an efficient grip between the user's hand and the pole with an extremely simple structure.

The intensity of the magnetic force provided by the contact of the two elements A, B (FIG. 5) is calibrated according to the age of the user. By way of example, for an adult man, an adsorption force of 8.34 Kgf for each permanent magnet is considered suitable at 0° C.

As mentioned previously, it is not necessary to provide permanent magnets on both the glove and the pole: the magnetic force required to obtain an effective coupling can, in fact, be applied between a permanent magnet applied on just one side (pole or glove) and a material with ferromagnetic properties applied to the other side. Moreover, in order to modify the intensity of the magnetic force to achieve an effective constraint, it is also possible to associate multiple permanent magnets/ferromagnetic materials on the same side (glove and/or pole).

Figure 4B:
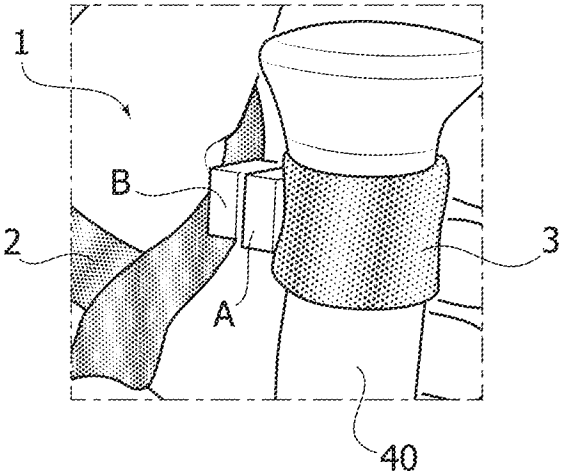
FIGS. 4A-4B illustrate two views of a detail of alternative embodiments of the invention.
Figure 4A:
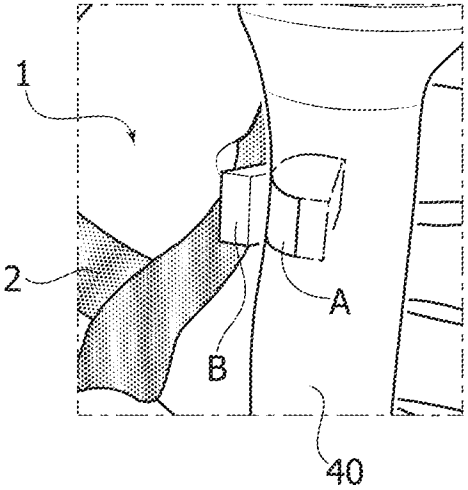
Figure 6:
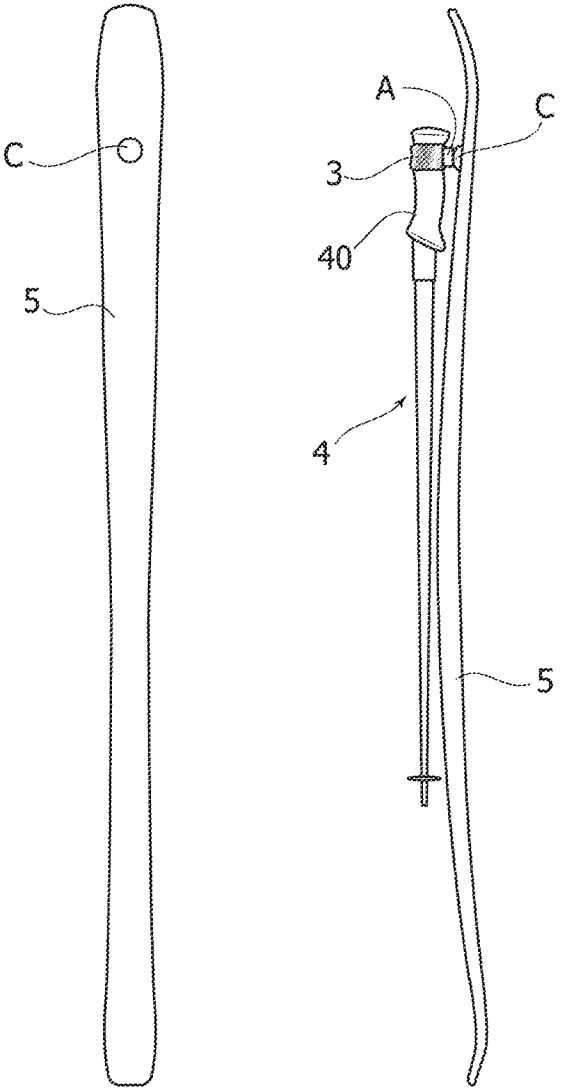
FIG. 6 illustrates a ski associable with the device according to the present invention.
Figure 5:
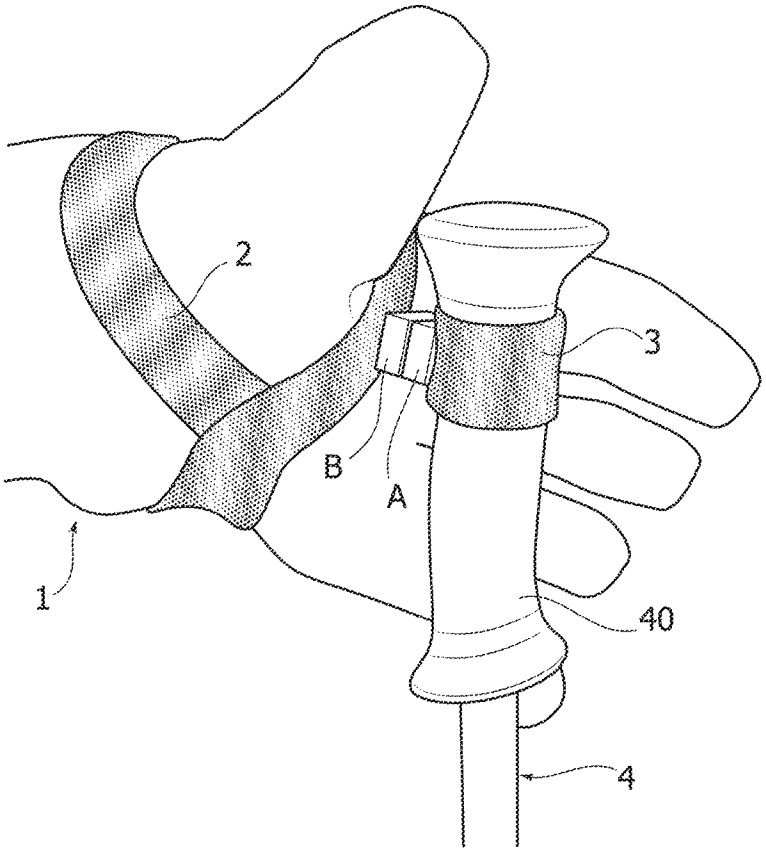
FIG. 5 illustrates a perspective view of the device illustrated in FIG. 3D.

According to another preferred characteristic of the invention illustrated in FIG. 4B, the two magnetic coupling elements A, B have flat front surfaces arranged for mutual contact. For example, the permanent magnets are made in the form of cubes which, as mentioned previously, can also be associated with each other on the glove and/or pole.

Thanks to the above-described structure of the device according to the invention, it is possible to obtain a ready and effective coupling to the handle 40 of the pole 4 without the aid of other elements besides the magnetic coupling elements A, B. At the same time, thanks to the arrangement of the first element A at the handle 40 and the arrangement of the second element B at the glove 1 between the thumb and the index finger, the magnetic force of the device is not excessive, so as to allow easy detachment of the user's hand from the pole 4, both voluntarily and involuntarily in the event of a fall. Thanks to the fact that the second magnetic coupling element 2 is arranged at the user's palm corresponding to an area between the thumb and the index finger, part of the user's hand is free of the magnetic attraction exerted between the first element A and the second element B, consequently, by keeping the pole 4 still (for example by pointing it into the snow), the user's hand can free itself from the magnetic attraction by exerting a rotary movement.

Figure 8:
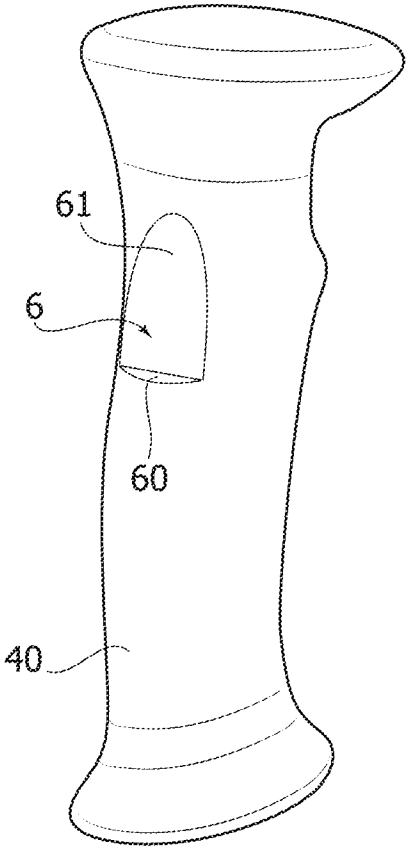
FIGS. 7 and 8 illustrate another embodiment of the device according to the present invention.
Figure 7:
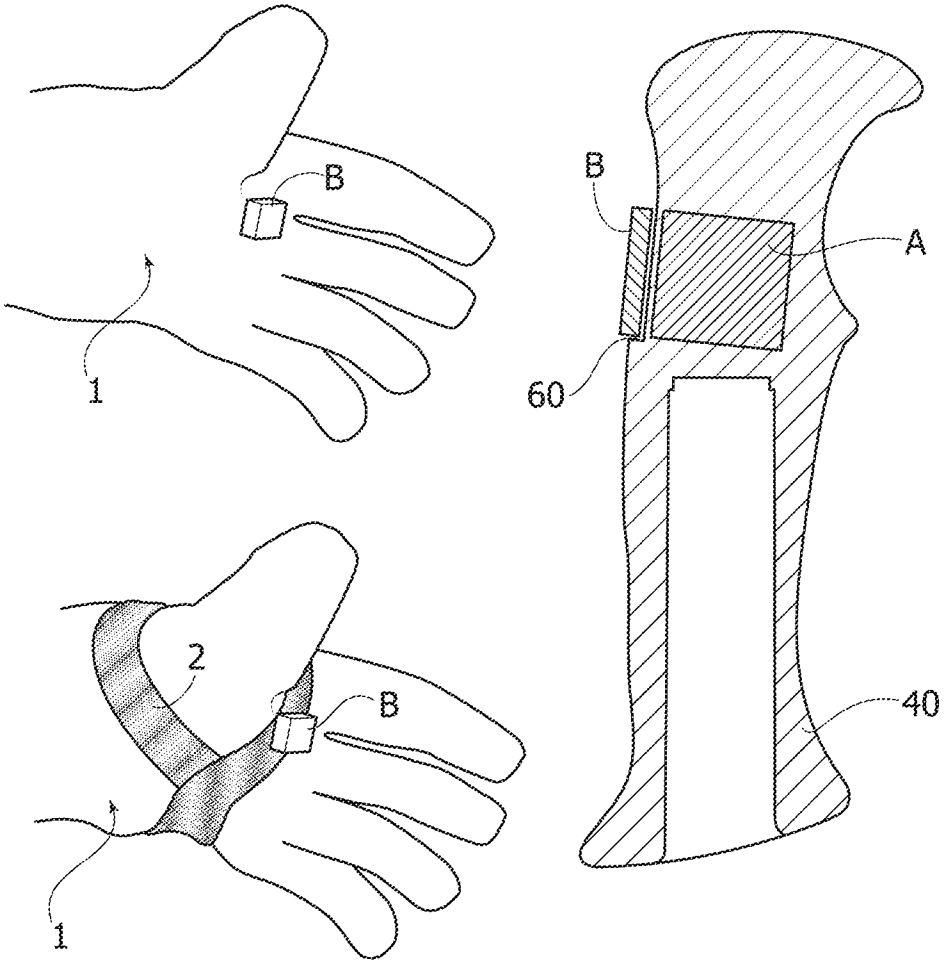

FIGS. 7 and 8 illustrate a particularly advantageous embodiment of the invention, in which the first element A is integrated within the handle 40 of the pole and is arranged close to the outer surface of the pole portion that can be gripped by the user, so that the first element A can be effectively coupled with the magnetic element B carried by the strap/sheath 2 fitted on the glove or directly by the user's glove. In order to allow insertion of the first magnetic element A within the handle 40, the handle 40 comprises a hollow portion arranged to receive the element A inside it and a cap, corresponding to the upper portion of the handle 40, arranged to close the aforesaid hollow portion.

Furthermore, again with reference to FIGS. 7 and 8, the handle 40 has a grooved portion 6 having a vertical wall 61 with a substantially flat surface and a horizontal wall 60 substantially arranged at 90 degrees with respect to said vertical wall 61. In the embodiment in which the element A is integrated within the handle 40, it is arranged adjacent to the grooved portion 6 and, specifically, to the vertical wall 61.

Thanks to the arrangement of the magnetic coupling element A within the handle 40, the duration of the magnetic adsorption force is considerably increased with respect to the case in which the element A is arranged outside the handle 40.

Moreover, the grooved portion 6 allows coupling between the pole and the user's hand to be improved, obtaining greater friction compared to a handle without this grooved portion. The friction and the magnetic coupling force cause an extremely effective coupling between the user's hand and the device.

The vertical wall 61 of the grooved portion 6 (FIG. 8) arranged close to the first magnetic coupling element A also allows the pole to be attached to metal elements of a ski-lift system (chair-lift, cable car or ski-lift), for example, during the use of this ski-lift system by the user.

According to another characteristic of the invention, a third magnetic coupling element C (for example, a sticker with ferromagnetic properties) is associated with each ski 5 of a user (in the case in which the device according to the present invention is used for skiing) so that the first element A can be coupled with the third element C.

Thanks to the structure described above, the device according to the invention is simple, functional, reliable and with low production costs.

The produced device also has a high versatility since it can be implemented both on a glove and a pole initially designed for housing magnetic elements, as well as on a glove and a pole that were not included with magnetic elements at the time of their production.

Of course, without prejudice to the principle of the invention, the details of construction and the embodiments may vary widely with respect to those described and illustrated purely by way of example, without departing from the scope of the present invention.

The invention claimed is:

1. A device for coupling a glove or other covering element of a user's hand with a pole for sportive practice, comprising:

at least one first magnetic coupling element associated or associable with said pole close to an upper end of said pole, at least one second magnetic coupling element associated or associable with said glove or with said other covering element, wherein at least one of said first and second magnetic coupling elements is a permanent magnet, said first magnetic coupling element arranged at a handle of said pole, and said second magnetic coupling element positioned at a palm portion of the glove or other covering element for the user's hand corresponding to an area between the thumb and the index finger;

wherein a coupling between said glove or said other covering element of the user's hand and said pole is provided only because of a magnetic force between said first magnetic coupling element and said second magnetic coupling element, without the aid of additional elements, such that a disconnection of said handle from said palm portion of said glove or said other covering element occurs in response to a decoupling of said first magnetic coupling element connected to said handle from said second magnetic coupling element connected to said pole;

said handle comprising a grooved portion having a vertical wall with a substantially flat surface from a top end to end to a bottom end thereof and a horizontal wall aligned substantially at 90° with respect to said vertical wall such that said horizontal wall extends from said bottom end away from a longitudinal axis of said handle; and said first magnetic coupling element received in a cavity of the handle of said pole and located adjacent to said vertical wall to allow a coupling of said first magnetic coupling element with said second coupling element and a frictional coupling between said second coupling element and said groove when said handle is gripped by the user.

2. A device according to claim 1, wherein said first magnetic coupling element and said second magnetic coupling element are both permanent magnets.

3. A device according to claim 1, wherein either said first magnetic coupling element or said second magnetic coupling element is formed of non-magnetized ferromagnetic material.

4. A device according to claim 1, wherein said first magnetic coupling element is carried by a strap, which is applicable around the handle of said pole.

5. A device according to claim 1, wherein said second magnetic coupling element is carried by a strap or a sheath fitted over said glove.

6. A device according to claim 1, wherein said second magnetic coupling element is carried by a hand-covering sheath, which can be directly worn on the user's hand.

7. A device according to claim 1, wherein said second magnetic coupling element is integrated directly into said glove.

8. A device according to claim 1, wherein the two magnetic coupling elements have flat front surfaces arranged for mutual contact.

9. A device according to claim 1, wherein a third coupling element is associated with each ski of a user so that said first magnetic coupling element can be coupled with said third element.

10. A device according to claim 1, wherein said first magnetic coupling element is integrated within the handle and is arranged close to the outer surface of the handle that is gripped by the user, so as to produce the magnetic coupling between said glove or other covering element of the user's hand and said pole.

11. The device of claim 1 wherein the pole comprises a ski pole.

* * * * *